United States Patent [19]

Inukai

[11] Patent Number: 4,512,518

[45] Date of Patent: Apr. 23, 1985

[54] ATOMIZING HEAD

[75] Inventor: Yuzo Inukai, Shizuoka, Japan

[73] Assignee: Fuji Photo Film Co., Ltd., Japan

[21] Appl. No.: 545,295

[22] Filed: Oct. 25, 1983

[30] Foreign Application Priority Data

Oct. 25, 1982 [JP] Japan ..... 57-161411[U]

[51] Int. Cl.[3] ..... B05B 3/10

[52] U.S. Cl. ..... 239/223

[58] Field of Search ..... 239/223, 224, 700–703

[56] References Cited

U.S. PATENT DOCUMENTS 3,000,574 9/1961 Sedlacsik ..... 239/224

3,043,521 7/1962 Wampler ..... 239/223

FOREIGN PATENT DOCUMENTS 49797 4/1980 Japan .

107255 7/1980 Japan .

*Primary Examiner*—Andres Kashnikow

*Assistant Examiner*—Scott D. Malpede

*Attorney, Agent, or Firm*—Sughrue, Mion, Zinn, Macpeak, and Seas

[57] ABSTRACT

A rotary atomizing head for an atomizer having a cup-shaped rotary atomizing head body mounted on the front end of a rotary shaft. The head body has a conical inner surface with a circular outer edge. A bell hub is provided in the atomizing head body and discharging passages are provided for guiding a liquid in the form of a film to the inner surface of said atomizing head body. The bell hub is a cylinder which has a liquid passage along the central axis thereof and conically recessed end faces.

9 Claims, 2 Drawing Figures

ATOMIZING HEAD

BACKGROUND OF THE INVENTION

This invention relates to atomizers. In particular it relates to a rotary atomizing head for an atomizer of the type where a viscous liquid such as paint is atomized by a rotary atomizing head turning at high speed, to strike an object to be coated therewith. A specific utilization is in a rotary atomizing head for an electrostatic coating machine.

Heretofore, a so-called "mini-bell type rotary atomizing head" has been extensively employed as the above-described rotary atomizing head. This device comprises: a cup-shaped rotary atomizing head body (or a bell rim) which is mounted on the front end of a rotary shaft and has a conical inner surface with a circular outer edge. A part receives a stream of paint to be atomized (or a bell hub) provided in the atomizing head body. Japanese Patent Application Laid-Open Nos. 147740/1978, 47159/1980 and 47160/1980 and Japanese Utility Model Application Laid-Open Nos. 49797/1980 and 107255/1980 disclose the structure of such conventional rotary atomizing heads for atomizers.

In the above-described mini-bell type rotary atomizing head, the liquid paint supplying nozzle supplies liquid paint to the bell hub, where a paint film is formed by the centrifugal force which is created by rotation of the cup-shaped atomizing head. The paint film thus formed is supplied through the discharging passages to the conical inner surface of the atomizing head body.

However, the conventional rotary atomizing head has the following deficiencies when supplying liquid paint. When the rotary atomizing head turns at a speed of about 4,000 r.p.m. or higher, a negative pressure is provided in the space in the atomizing head, so that air is included into the space; that is, a so-called "air pumping phenomenon" occurs. In this operation, some of the water based paint droplets discharged from the rotating discharging edge stick to the inner surface of the atomizing head, going with the air which is induced into the space in the atomizing head. On the inner surface where no water based paint film is formed, moisture is evaporated from the droplets sticking thereto. As a result, the solid components are deposited. If, under this condition, water paint is atomized continuously for a long period of time, the solid components are successively deposited to grow vertically which finally obstructs the film flow of water paint. If atomizing further continues, droplets will stick to the discharging edge of the inner surface where the flow of water paint is obstructed. Hence, solid components are deposited, thus growing to the discharging edge.

Accordingly, while being guided, in the form of a film to the discharging edge, the water paint cannot be formed into a uniform film. Therefore, in the case where the atomizing head is used for a coating machine, the water paint droplets are large in diameter, thus lowering the quality of coating. Furthermore, in the case of a coating machine using an air motor, the speed of rotation of the atomizing head is decreased by solid components deposited, thus causing the same difficulty.

The paint supplying nozzle supplies water paint to a paint receiving part, where a water paint film is formed by the centrifugal force. The water paint film thus formed is guided to the inner surface of the atomizing head. In this operation moisture evaporates from the water paint in the solid-gas-liquid interface in the atomizing head and the solid components thereof are deposited in the interface. If, under this condition, water paint is atomized continuously for a long period of time, then the solid components successively deposited are mixed with the supplied water paint. Accordingly, the solid components are discharged from the discharging edge without being dissolved before reaching the discharging edge. Therefore, if the atomizing head is used for a coating machine, large masses of solid components may exist in the water paint droplets, thus lowering the quality of coating. In the case when the solid components have stuck to the inner surface of the atomizing head without being discharged from the discharging edge, the solid components are not dissolved in the water paint film.

Accordingly, it is difficult to form a uniform film on the discharging edge where the solid components have stuck, so that the droplets are stuck to the discharging edge of the inner surface where no film has been formed. As described above, the solid components are deposited in that location, thus lowering the quality of coating. The speed of rotation of the atomizing head is decreased by the solid components thus deposited, thus causing the same trouble.

SUMMARY OF INVENTION

Accordingly, an object of this invention is to provide a rotary atomizing head in which the above-described difficulties accompanying a conventional rotary atomizing head for an atomizer have been eliminated.

It is another object of this invention to provide a rotary atomizing head where depositing and drying of the solid components of liquid paint are prevented, to provide an excellent coating result. Yet another object of this invention is to provide a rotary atomizing head for an atomizer which has excellent stability for a long period of time.

The foregoing objects and other objects of the invention have been achieved by a rotary atomizing head for an atomizer which comprises an atomizing head body having a conical inner surface with a circular outer edge. A bell hub is provided in the atomizing head body with discharging passages for guiding a liquid in the form of a film to the inner surface of the cup-shaped atomizing head body. The bell hub is a cylinder which has a paint passage along the central axis thereof and conically recessed end faces.

This invention will be described with reference to its preferred embodiments shown in the accompanying drawings in detail.

DESCRIPTION OF THE PREFERRED EMBODIMENT

Figure 1:
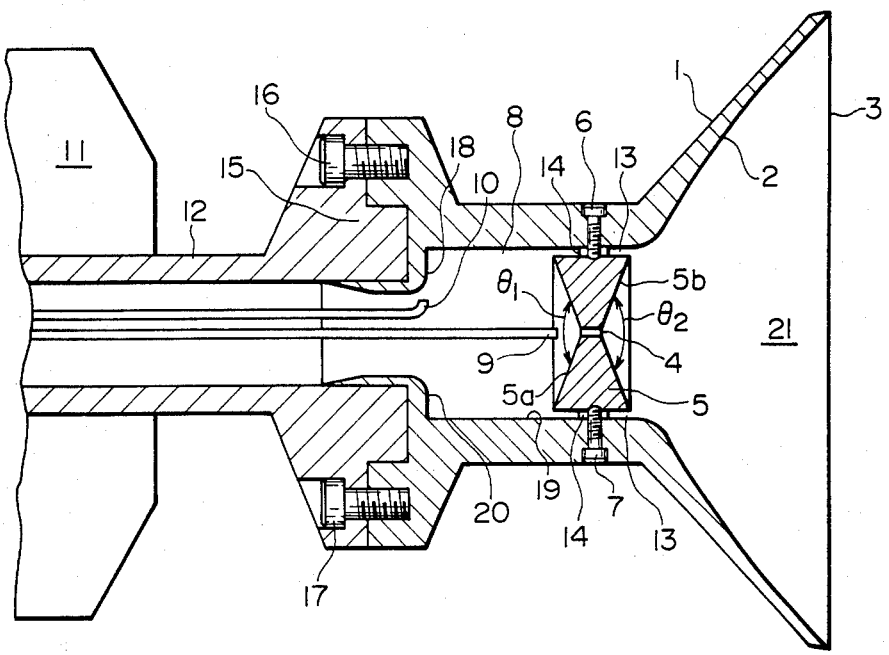
FIG. 1 is a longitudinal sectional view of a rotary atomizing head for an atomizer according to this invention model.
Figure 2:
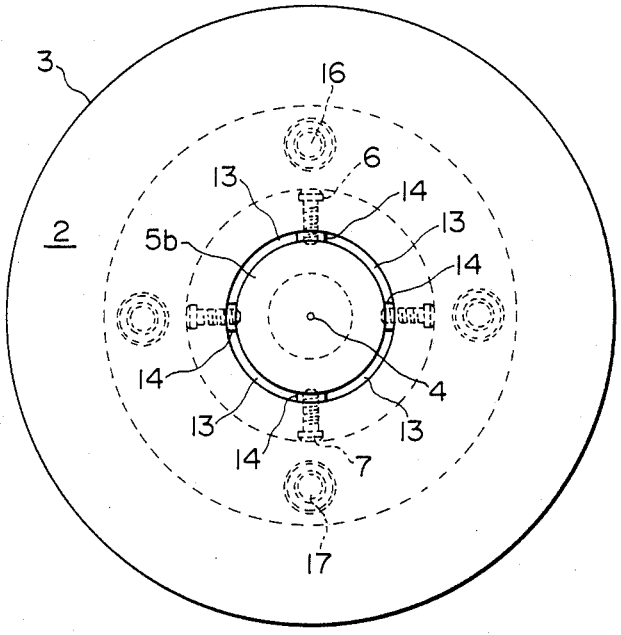
FIG. 2 is a front view of the rotary atomizing head.

As shown in FIGS. 1 and 2, an atomizing head body 1 has a conical inner surface 2 which has a circular outer edge 3. The atomizing head body 1 is also called a bell rim. A cylinder 5 having a liquid passage 4 along its central axis is coaxially disposed inside the atomizing head body 1. The cylinder 5 is fixedly secured to the atomizing head body 1 with screws 6 and 7. A supplying nozzle 9 is disposed in the space 8 which is defined by the atomizing head body 1 and the cylinder 5 in such a manner that the axis of the nozzle 9 is in alignment with the central axis of the passage 4. A steam supplying nozzle 10 is also disposed in the space 8. Nozzles 9 and 10 extend through the shaft 12 of an air motor 11, and the other ends (not shown) of the nozzles are fixedly secured.

A plurality of slit-shaped discharging passages 13 are formed between the atomizing head body 1 and the cylinder 5. Each discharging passage 13 opens to the space 8 defined by the atomizing head body 1 and the cylinder 5 on one side and opens to the space which is defined by the conical inner surface of the atomizing head body 1. A plurality of streamlined supports 14 are formed between the discharging passages so that paint flows out. One end of the shaft 12 of the air motor 11 is formed with a flange 15 which is coaxial with the shaft 12. The atomizing head body 1 is coaxially mounted on the flange 15 with screws 16 and 17.

When a high voltage is applied to the air motor 11 through leads (not shown), the atomizing head body 1 coaxially mounted on the flange 15 is turned at high speed. When, under this condition, it is required to supply steam, a steam supplying device (not shown) continuously supplies through a steam supplying nozzle 10 to the corner 18 of the rear opening of the atomizing head body. On the other hand, under this condition a supply device (not shown) supplies liquid to be applied (for example, a water based paint) through the paint supply nozzle 9 to one end face of the cylinder 5, namely, a receiving part 5*a* which is in the form of a conical inner surface. One portion of the liquid this supplied is discharged onto the conical inner surface 2 while being formed into a film at the other end face of the cylinder 5, namely, an opening end face 5*b* by the centrifugal force which is produced by rotation of the atomizing head body 1. The remaining liquid is discharged onto the inner wall 19 of the space 8 defined by the atomizing head body 1 and the cylinder 5 while being formed into a film at the receiving part 5*a* by the centrifugal force which is provided by rotation of the atomizing head body 1. The film thus formed, being reduced in thickness at the inner wall 19 by centrifugal force, is sent through the plurality of slit-shaped discharging passages 13 to the conical inner surface 2 of the atomizing head body 1.

In the case where the inner wall 19 of the space 8 is defined by the head body 1 and the cylinder 5 is used as a liquid pool for allowing the centrifugal force to form the liquid into a uniform film, the conical angle $\theta_1$ of the liquid receiving part 5*a* should not be more than 180°. In addition, it is not preferable in view of the structure of the atomizing head body 1 and the cylinder 5 that the angle $\theta_1$ is smaller than 30°. Thus, the conical angle $\theta_1$ should be in the range of from 30° to 180° (15°-90° to the central axis, i.e., axis of rotation), preferably 60° to 180° (30°-90° to the central axis). The plurality of stream-lined supports 14 between the plurality of slit-shaped discharging passages 13 form a substantially uniform film, spreading to the conical inner surface 2 of the atomizing head body 1, without disturbing the flowing of the liquid film. The liquid in the form of a uniform film join the liquid which is formed into a film at the end face 5*b* of the cylinder and discharged onto the conical inner surface 2. The resultant film is further reduced in thickness at the conical inner surface 2 of the atomizing head body 1, thus being atomized at the outer edge 3 of the atomizing head body 1.

The number of slit-shaped discharging passages 13 and the number and configuration of stream-lined supports 14 may be modified according to the use of the cup-shaped rotary atomizing head.

In order to form a film of liquid at the opening end face 5*b* of the cylinder 5, the conical angle of the end face 5*b* may be 30° to 270° (15°-135° to central axis), preferably 60° to 240° (30°-120°) for stability of a formed film and because of the dimensional limits of the atomizing head body 1 and the cylinder 5.

The liquid, for example a water based paint supplied to the receiving part 5*a* forms a three-phase (solid, gas and liquid) interface at the inner wall 20 of the rear part of the atomizing head body 1. This results in a deposit of the solid components of the water based paint in the three-phase interface. On the other hand, the aforementioned air pumping phenomenon caused by the high speed rotation of the atomizing head tends to deposit the solid contents of the water paint droplets, which are formed fat the edge 3 of the atomizing head body 1, into an atomizing head internal space 21, so that the droplets stick to the opening end face 5*b* of the cylinder 5 and the solid components of the droplets thus stuck are deposited. However, as steam is maintained supplied through the steam supplying nozzle 10 to the inner wall 20 of the rear part of the atomizing head body continuously before the water paint is supplied to the atomizing head, deposition and sticking of the solid components of the water paint in the three-phase interface at the inner wall 20 of the rear part of the atomizing head body are prevented. The water paint supplied through the paint supplying nozzle 9 is passed through the paint passage 4, and is then formed into a film at the opening end face 5 by the centrifugal force as described above. This water paint can prevent, by its own washing action, the deposition of the solid components of the droplets which are stuck to the end face 5*b* by the air pumping phenomenon. Depending on the composition of a water paint used and the structure of the atomizing head body, steam is supplied through the steam supplying nozzle 10 as required.

A key aspect of this invention resides in that, as described above, the supplied water paint film is formed on the opening end face 5*b* of the cylinder 5 by the centrifugal force created by rotation of the atomizing head to the extent that the solid components of water based paint droplets are not deposited by the air pumping phenomenon. Accordingly, in a series of processes in which water based paint is supplied through the paint passage 4 to the center of the opening end face 5*b*, the water based paint film is affected by the amount of water paint supplied through the paint supplying nozzle 9, the inside diameter of the paint supplying nozzle 9, the position of the nozzle 9, the distance between the paint passage 4 and the nozzle 9, the inside diameter and the length of the paint passage 4, the conical angles of the paint receiving part 5*a* and the opening end face 5*b*, the speed of rotation of the atomizing head, and the viscosity of the water based paint.

For example, in the case where the water based paint flowing out of the paint supplying nozzle 9 is applied to a part of the paint receiving part 5*a* which is away from the center of the paint passage 4, then it cannot pass through the paint passage 4, and accordingly cannot form a film at the opening end face 5*b*. When the paint is supplied to the center of the paint passage, no film is formed at the outer end face 5*b* if the pasage 4 is small. Even if the film is formed, its thickness is small, and accordingly the deposition of the solid components in the water paint droplets cannot be prevented. In the case when the interior diameter of the paint passage 4 is large, total amount of paint are not formed into a film; that is, a part of the water based paint splashes out becoming large drops or slides down the outer end face 5*b*. These phenomena are in close relation with the above-described factors such as the inside diameter of the paint supplying nozzle 9, the amount of water based paint supplied through the nozzle 9, and the length of the paint passage 4. These can be suitably determined according to the conditions such as the amount of water based paint to be atomized and the speed of rotation of the atomizing head.

In order to clarify the effects of the rotary atomizing head according to the invention, one concrete example and several comparison examples will now be described.

CONCRETE EXAMPLE

An electrostatic spraying operation was carried out with the rotary atomizing head according to the invention shown in FIGS. 1 and 2, under the following conditions. In this operation, no solid components in the water based paint were deposited at all, the average spot size of atomized droplets is about thirty microns, and the speed of rotation of the atomizing head was maintained substantially unchanged.

Water based paint—metylmethaacrylate—ethylacrylate soda acrylate (ratio by weight 68:29:12 (charging ratio))copolymer polymer aqueous solution (solid component density 10%, 4 centipoises).

Flow rate of paint—50 milli-liters per minute

Voltage applied to the electrostatick coating head——90 KV

Speed of rotation of the atomizing head—30,000 r.p.m.

Amount of steam supplied to the atomizing head (converted into water)—0.8 milli-liter per minute Inside diameter of the paint passage 4—0.8 mm Conical angles—$\theta_1=120°$, $\theta_2=120°$

COMPARATIVE EXAMPLE 1

An electrostatic spraying operation was carried out under the same conditions as those in the above-described concrete example except that the paint passage 4 was closed. Immediately solid components were deposited. In about one hour, it become difficult to form the water based paint film on the atomizing head inner surface, the speed of rotation of the atomizing head was reduced to 24,000 r.p.m., and the average spot size of the atomized droplets was increased to eighty microns. In addition, spots of about 300 microns were found, thus lowering the quality of coating. However, no solid components were deposited on or stuck to the inner wall of the rear part of the atomizing head.

COMPARATIVE EXAMPLE 2

An electrostatic spraying operation was carried out under the same conditions as those in the concrete example except that the flow rate of water based paint was set to 100 milli-liters per minute. The results of the operation were similar to those of the concrete example; however, large drops splashed out of the paint passage, sticking to an object to be coated. Thus, the quality of coating was unsatisfactory.

As is apparent from above description, according to the invention, the cylinder having the paint passage along its central axis and the conical end faces is employed as the bell hub. Accordingly, the problem where the solid components in a liquid are deposited on th conical end faces are dried there can be prevented by the self-washing action of the liquid. In addition, liquid droplets can be prevented from sticking and accumulating in the vertical direction. The combination of these effects can provide a rotary atomizing head for an atomizer with which the coating is stable and excellent in quality for a long time.

The rotary atomizing head according to the invention is effective in performing an electrostatic coating operation with volatile liquids as well as in performing an electrostatic coating operation with volatile paint.

While the invention has been described with reference to its preferred embodiments, it should be noted that it is not limited thereto or thereby. That is, the number of supports in the discharging passages and the curvature of the conical inner surface may be changed without departing from the technical scope of the invention.

I claim:

1. A rotary atomizing head for an atomizer comprising;

a cup-shaped rotary atomizing head body mounted at its rear end on the front end of a rotary shaft; said head body having a conical inner discharge surface with a circular outer edge; a cylindrical bell hub provided in said atomizing head body; discharging passages provided for guiding a liquid in the form of a film to the inner surface of said atomizing head body; and said bell hub having a liquid passage along the central axis thereof and conically recessed end faces.

2. The rotary atomizing head of claim 1 wherein said head has an axially disposed supply nozzle; said cylindrical bell hub has a first conically recessed end face confronting said supply nozzle, said first conically recessed end face disposed at an angle of 15°-90° to the central axis.

3. The rotary atomizing head of claim 2 wherein said angle is 30°-90° to said central axis.

4. The rotary atomizing head of claim 1 wherein said cylindrical bell hub has a second conical end face opening to said conical inner surface, said second conical end face disposed at an angle of 15°-135° to said central axis.

5. The rotary atomizing head of claim 4 wherein said second conical end face is disposed at an angel of 30°-120° to said central axis.

6. The rotary atomizer of claim 1 further comprising a steam supply nozzle extending through said rotary shaft into said atomizing head body.

7. The rotary atomizer of claim 6 wherein said head body has a cylindrical inner body portion with a corner portion at the rear end thereof and said steam supply nozzle facing said corner portion to supply steam thereto.

8. The rotary atomizer of claim 1 further comprising means to mount said bell hub to said atomizing head body and wherein said discharge passages extend between said means to mount.

9. The rotary atomizer of claim 8 wherein said atomizing head body comprises an inner cylindrical wall facing outward to form said conical inner discharge surface and wherein said discharge passages are disposed annularly between said inner cylindrical wall and the outer surface of said bell hub.

* * * * *